US009151101B2

(12) United States Patent
Lowe

(10) Patent No.: US 9,151,101 B2
(45) Date of Patent: Oct. 6, 2015

(54) DETACHABLE HINGE DAMPER

(71) Applicant: Hardware Resources, Inc., Bossier City, LA (US)

(72) Inventor: Mark Jeffrey Lowe, Bossier City, LA (US)

(73) Assignee: Hardware Resources, Inc., Bossier City, LA (US)

( * ) Notice: Subject to any disclaimer, the term of this patent is extended or adjusted under 35 U.S.C. 154(b) by 0 days.

(21) Appl. No.: 14/150,525

(22) Filed: Jan. 8, 2014

(65) Prior Publication Data

US 2014/0115823 A1 May 1, 2014

Related U.S. Application Data

(63) Continuation-in-part of application No. 13/199,670, filed on Sep. 7, 2011, now abandoned.

(51) Int. Cl.

| | |
|---|---|
| ***E05F 5/02*** | (2006.01) |
| ***E05F 5/08*** | (2006.01) |
| ***E05F 5/00*** | (2006.01) |

(52) U.S. Cl.

CPC . *E05F 5/08* (2013.01); *E05F 5/006* (2013.01); *Y10T 16/625* (2015.01)

(58) Field of Classification Search

CPC ..... E05F 5/006; E05F 5/02; E05F 5/06; E05F 5/10

USPC ..... 16/286, 362, 82, 84, 85

See application file for complete search history.

(56) References Cited

U.S. PATENT DOCUMENTS

| | | | | |
|---|---|---|---|---|
| 4,155,144 | A | 5/1979 | Koganei | |
| 4,190,925 | A | 3/1980 | Koivusalo | |
| 4,413,373 | A | 11/1983 | Sasaki | |
| 4,485,522 | A | 12/1984 | Chen | |
| 4,829,628 | A | 5/1989 | Vuksic | |
| 5,016,317 | A | 5/1991 | Hung | |
| 5,383,253 | A | 1/1995 | Lin et al. | |
| 5,794,310 | A * | 8/1998 | Dallmann | 16/362 |
| 6,904,642 | B2 | 6/2005 | West | |
| 6,928,699 | B2 | 8/2005 | Sawa | |
| 7,669,285 | B2 * | 3/2010 | Gallasch et al. | 16/286 |
| 2008/0209674 | A1 | 9/2008 | Harald et al. | |
| 2008/0271294 | A1 * | 11/2008 | Lautenschlager | 16/374 |
| 2009/0165244 | A1 * | 7/2009 | Pyo | 16/250 |

* cited by examiner

*Primary Examiner* — Emily Morgan

(74) *Attorney, Agent, or Firm* — Schultz & Associates, P.C.

(57) ABSTRACT

A detachable and adjustable damper hinge attachment for connection to pre-installed hinge hardware to dampen the closing motion of a swinging cabinet door. The attachment comprises a housing and a spring damper assembly slidingly and removably engaged with the housing. The housing includes an attachment means for detachable engagement with a hinge body. The spring damper assembly extends from the housing and contacts a portion of the hinge to which the door is mounted. One embodiment positions the spring damper assembly to more perpendicularly meet the door portion of the hinge. Another embodiment includes an adjustment knob for adapting the contact point of the spring damper assembly.

6 Claims, 13 Drawing Sheets

DETACHABLE HINGE DAMPER

CROSS REFERENCE TO RELATED APPLICATION

This application is a continuation in part of U.S. application Ser. No. 13/199,670 filed Sep. 7, 2011. The patent application identified above is incorporated here by reference in its entirety to provide continuity of disclosure.

FIELD OF THE INVENTION

The present invention relates to damping mechanisms slowing the closure of cabinet door hinges. In particular, the invention relates to a detachable, adjustable, and reusable attachment for connection to pre-existing hinge assemblies that provides a damped door closure.

BACKGROUND OF THE INVENTION

In the field of cabinetry and mill work a pervasive problem is uncontrolled closure of doors. Uncontrolled closure often results in slamming of cabinetry doors creating unwanted noise and premature wearing of cabinet hinges and cabinet faces. The art has responded generally to this problem by providing damping mechanisms.

Damping mechanisms are generally comprised of a spring loaded piston contained in a fluid filled cylinder for engagement with the back side of the cabinet door. In the prior art, the damping mechanism is often very close to the pivot axis of the hinge. Such placement increases the force perpendicular to the piston rod on closure of the cabinet door thereby wearing the piston rod and the seals which contain the damping fluid. Failure of the seals or the piston rod thus shortens the life cycle of the entire hinge because of the failure of the damping piston.

Premature failure is also caused by the inability of prior art hinges to adjust to the weight of the cabinet door on which they are employed.

U.S. Pat. No. 4,190,925 to Koivusalo discloses a damped hinge. A first hinge plate is attached to the door and a second to the door frame. The first hinge plate is provided with a pair of guide sleeves in which a force-transmitting rod is guided for movement in a direction parallel to the hinge axis. A helical cam attached to the second hinge plate and the piston rod follows a slot when the door swings and moves the piston rod. The piston rod is housed vertically thus adding bulk to the hinge assembly. Since the hinge is integral to the damper, failure of the damper requires replacement of the hinge. Further, the angle of contact of the hinge with the damper is extreme, leading to premature wear and failure.

U.S. Pat. No. 5,383,253 to Lin discloses a hydraulic buffer hinge. The device couples a cushion spring connected to two swinging plates with a hydraulic buffer to slow the return stroke of a swinging door. The cushion spring is aligned parallel to the pivot axis of the hinge while the piston of the hydraulic buffer is aligned perpendicularly to the pivot axis of the hinge. The damping force of the self-contained hydraulic buffer is not adjustable. Upon failure, the entire hinge assembly requires replacement.

U.S. Pat. No. 6,928,699 to Sawa discloses an automatic closing door hinge mechanism. A first wing plate includes a cylinder and a piston while a second wing plate includes an operation rod engaged with the piston. A cam is formed on the piston. An engaging part provided on the operation rod is movable in the cam. A sphere on the outer surface of the piston moves in a lengthwise groove in the cylinder to allow the piston to slide within the cylinder. Impact of the door closing is pneumatically damped within the cylinder. The apparatus is bulky and requires replacement upon failure of the piston.

Referring to FIGS. 1A and 1B, the prior art also includes "piggy back" type damper arrangement 5000 having body 5001 designed to attach to hinge arm 6001 of recessed hinge arrangement 6000. The placement of damper arrangement 5000 in the prior art is on top of hinge arm 6001 and adjacent to hinge plate 6003. The placement allows for contact of absorber 5003 with hinge plate 6003 of hinge cup 6002 for approximately 20 degrees of travel of hinge 6000 between impact position 3000 and closed position 3001. Because of the 20 degree hinge travel, the throw of absorber 5003 is extremely short and relatively ineffective at slowing the closure of a typical cabinet door. The addition of damper arrangement 5000 more than doubles the total height of hinge arm 6001 located in the cabinet thereby interfering with storage space and cabinet use.

Further, when the damper mechanism fails, the entire hinge assembly must often be replaced. Removing the entire cabinet door and replacing the hinge instead of repairing it increases the cost of replacement.

Thus, there is a need for a damper hinge device that is compact and removable.

There is also a need for a damper hinge device that extends the life cycle of the mechanism and the surrounding cabinetry.

There is also a need for a damper hinge device which is capable of contact point adjustment to provide for various applications.

It is also desirable to effectuate a damped hinge mechanism which extends the operational contact angle thereby allowing for extended contact and more effective door closure.

It is also desirable to effectuate a damper hinge mechanism with a low profile to reduce interference with operation and conserve space.

SUMMARY

In a preferred embodiment, the damper hinge mechanism comprises a body having a connector portion and a housing portion, a spring damper assembly slidingly and removably engaged with the interior of the housing portion.

The spring damper assembly comprises a cylinder slidingly engaged with a piston and a piston rod. The cylinder is filled with a damping fluid such as mineral oil surrounding the piston rod and a spring biasing the piston. The cylinder includes a flexible tip for engagement with the hinge part mounted on the cabinet door. In various embodiments, the flexible tip is a dense energy absorbing foam rubber, rubber, or plastic.

In one embodiment, the connector portion includes a fastening hook and a plurality of support abutments for removable engagement with a standard hinge body. In this embodiment, the housing portion is angled with respect to the connector portion to engage the hinge part mounted on a swinging door at an angle which reduces stress on the piston and cylinder.

In another embodiment, the connector portion includes a securing hook, an adjustment hole to allow a user to adjust the hinge, and a cam locking mechanism. In this embodiment, the housing portion has a gap along the axis of the housing portion to reduce weight and material costs. This embodiment further comprises an adjustment knob for adjusting the contact point and the compressive strength of the spring damper assembly with a hinge part mounted on a swinging door. The piston rod is removably supported by the adjustment knob. The adjustment knob is threaded into the housing portion, providing axial adjustment for the spring damper assembly.

BRIEF DESCRIPTION OF THE DRAWINGS

The disclosed embodiments will be described with reference to the accompanying drawings. Like pieces in different drawings carry the same number.

DETAILED DESCRIPTION

Figure 1A:
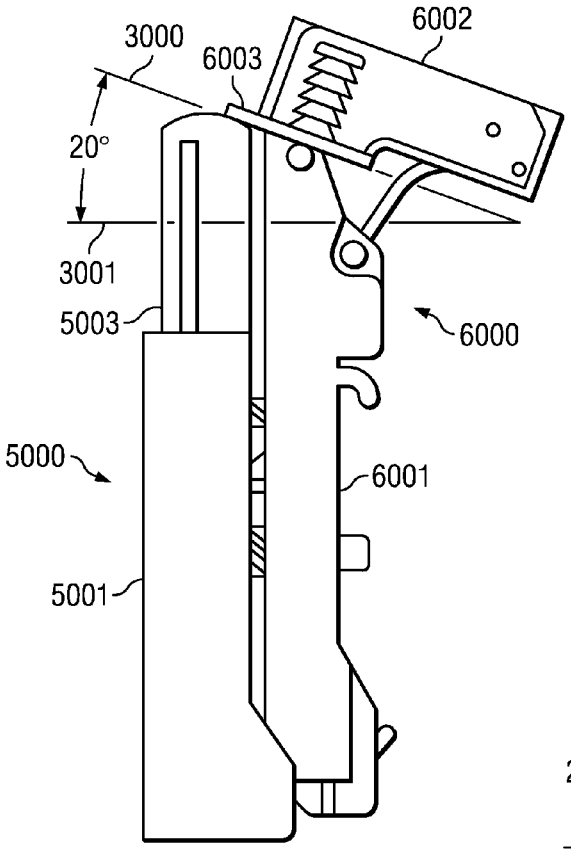
FIG. 1A (PRIOR ART)
FIG. 1A is a side view of a damper of the prior part.
Figure 1B:
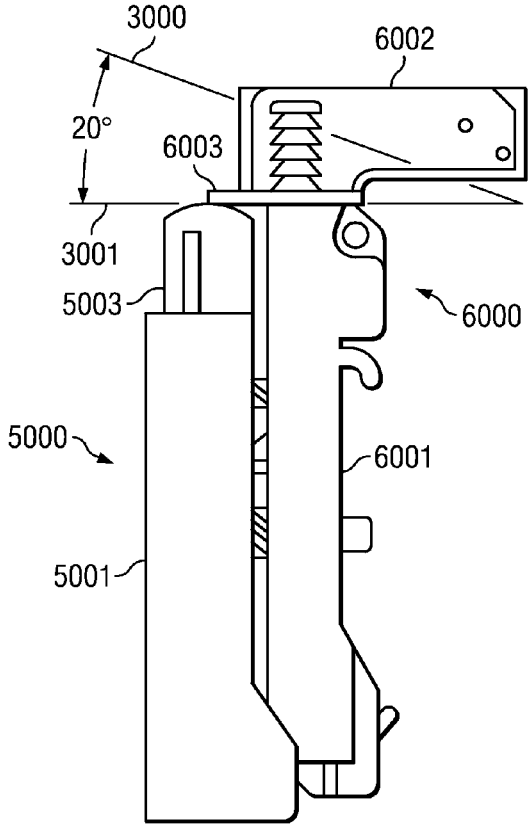
FIG. 1B (PRIOR ART)
FIG. 1B is a side view of a damper of the prior art.
Figure 2:
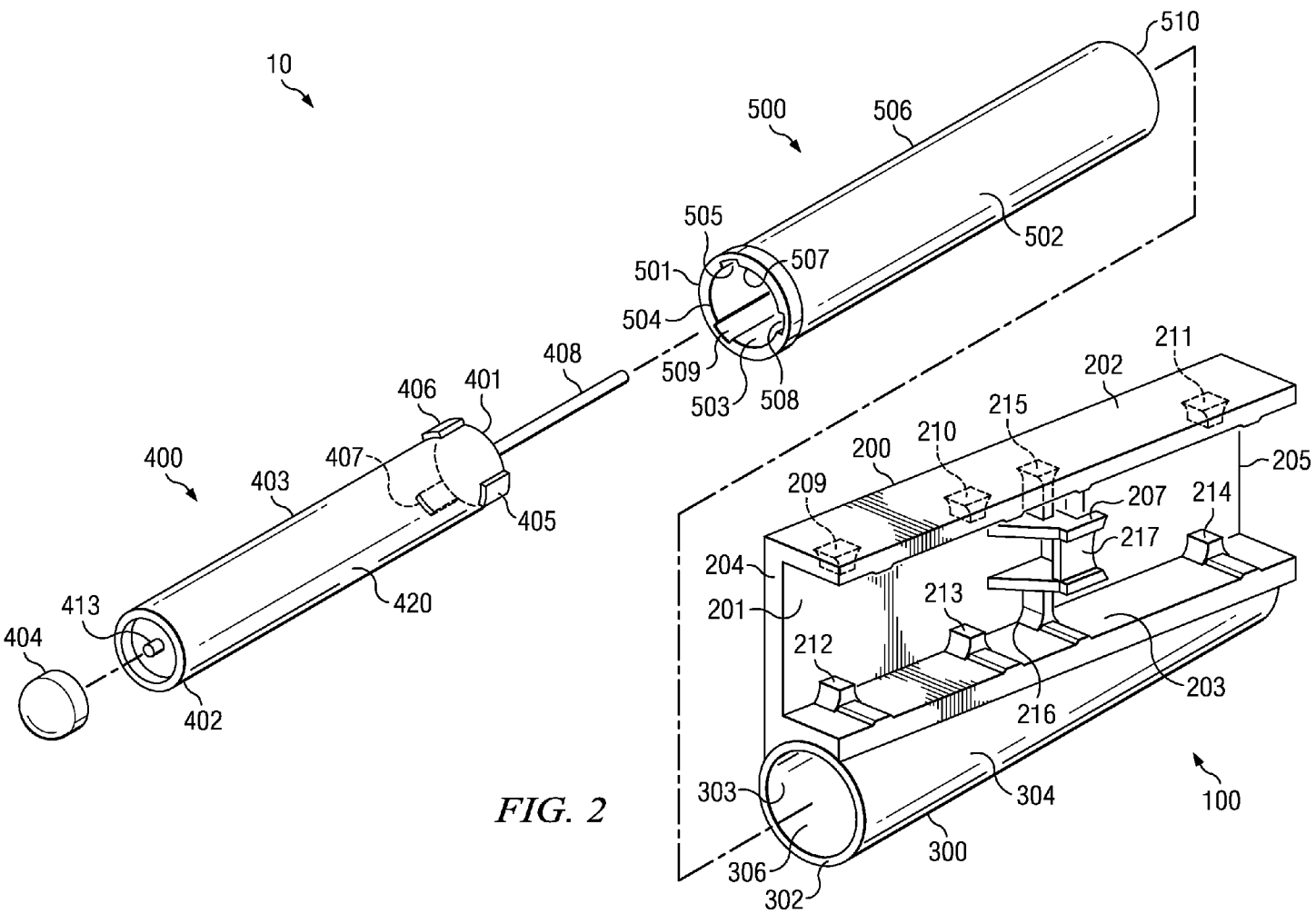
FIG. 2 is an exploded isometric view of a preferred embodiment.

Referring to FIG. 2, attachment 10 comprises body 100, receiver 500, and spring damper assembly 400. Body 100 has connector portion 200 and housing portion 300. Connector portion 200 has base 201, attached to housing portion 300, side 202, side 203, end 204, and end 205. Connector portion 200 extends generally radially from housing portion 300. Side 202, end 205, and side 203 form a generally rectangular channel at end 205. Side 202, end 204, and side 203 form a generally rectangular channel at end 204. Fastening hook 207 and support 217 are attached to base 201. Housing portion 300 is off-set with respect to connector portion 200.

Base 201 has support abutments 209, 210, 215, and 211, all of which are angled to facilitate the off-set position of housing portion 300 and are adjacent to side 202 attached to base 201. Support abutment 215 is adjacent to side 202 and fastener hook 207. Base 201 further has support abutments 212, 213, 216, and 214, all of which are angled to facilitate the off-set position of housing portion 300 and are adjacent to base 201 and side 202. Support abutment 216 is adjacent to side 203 and fastener hook 207. Support abutment 209 is positioned adjacent to side 202, generally opposite from support abutment 212 adjacent to side 203. Support abutment 210 is positioned adjacent to side 202, generally opposite support abutment 213 adjacent to side 203. Support abutment 211 is positioned adjacent to side 202, generally opposite support abutment 214 adjacent to side 203.

Housing portion 300 has spring damper end 302, inside surface 303, and outside surface 304.

In a preferred embodiment, body 100 is made of a durable plastic, but can be made of other rigid materials such as cast aluminum, metal, metal alloy, or zinc die cast.

Receiver 500 has flange 501, barrel 502, inside surface 507, and outside surface 506. Flange 501 has hole 503 and slots 505, 508, and 509 at proximal end 504 to slidingly receive spring damper assembly 400. Receiver 500 is inserted into hole 306 and outside surface 506 is frictionally engaged with inside surface 303 of housing portion 300.

In a preferred embodiment, receiver 500 is made of a durable plastic, but can be made of other materials such as a durable metal or metal alloy.

Spring damper assembly 400 is slidingly engaged with inside surface 507 of receiver 500 and removably supported by receiver end 510. Spring damper assembly 400 comprises cylinder 420 having proximal end 401, distal end 402, and outside surface 403. Flexible tip 404 has a generally convex shape and is removably attached to distal end 402 by frictional engagement with mounting post 413 and distal end 402. Guide flanges 405, 406, and 407 are attached to outside surface 403 at proximal end 401 and slidingly engage with slots 505, 508, and 509 in flange 501 of receiver 500. Piston rod 408 is slidingly engaged with proximal end 401 and is connected to a piston. The piston is slidingly engaged with an inside surface of cylinder 420. The inside surface of cylinder 420 forms a fluid chamber, which contains a damper fluid. Piston rod 408 is concentrically aligned with a piston guide in proximal end 401. The piston guide forms a seal with piston rod 408 to prevent the damper fluid from escaping cylinder 420. The piston has at least one fluid channel through which the damper fluid can pass. A spring is positioned between the piston and distal end 402 and urges against the piston and distal end 402.

In a preferred embodiment, cylinder 420 is formed of extruded plastic or other suitable materials for lightweight durability and affordability. Piston rod 408 is made of aluminum, but can be made of other metals or metal alloys with similar lightweight and strength properties. The piston is made of aluminum or can be made of other durable, lightweight materials known in the art. Flexible tip 404 may be made of plastic, rubber, or a dense energy absorbing foam rubber. The damper fluid is a mineral oil, but other fluids known in the art may be suitably employed. The damper fluid fills approximately 80% of the volume of the inside of cylinder 420 less the volumes of piston rod 408, the piston, and the spring. Other suitable fluid capacities known in the art may be employed as well. The spring is made of a durable metal with a spring constant in a range of approximately 10 lbs./inch to 20 lbs./inch.

Figure 3A:
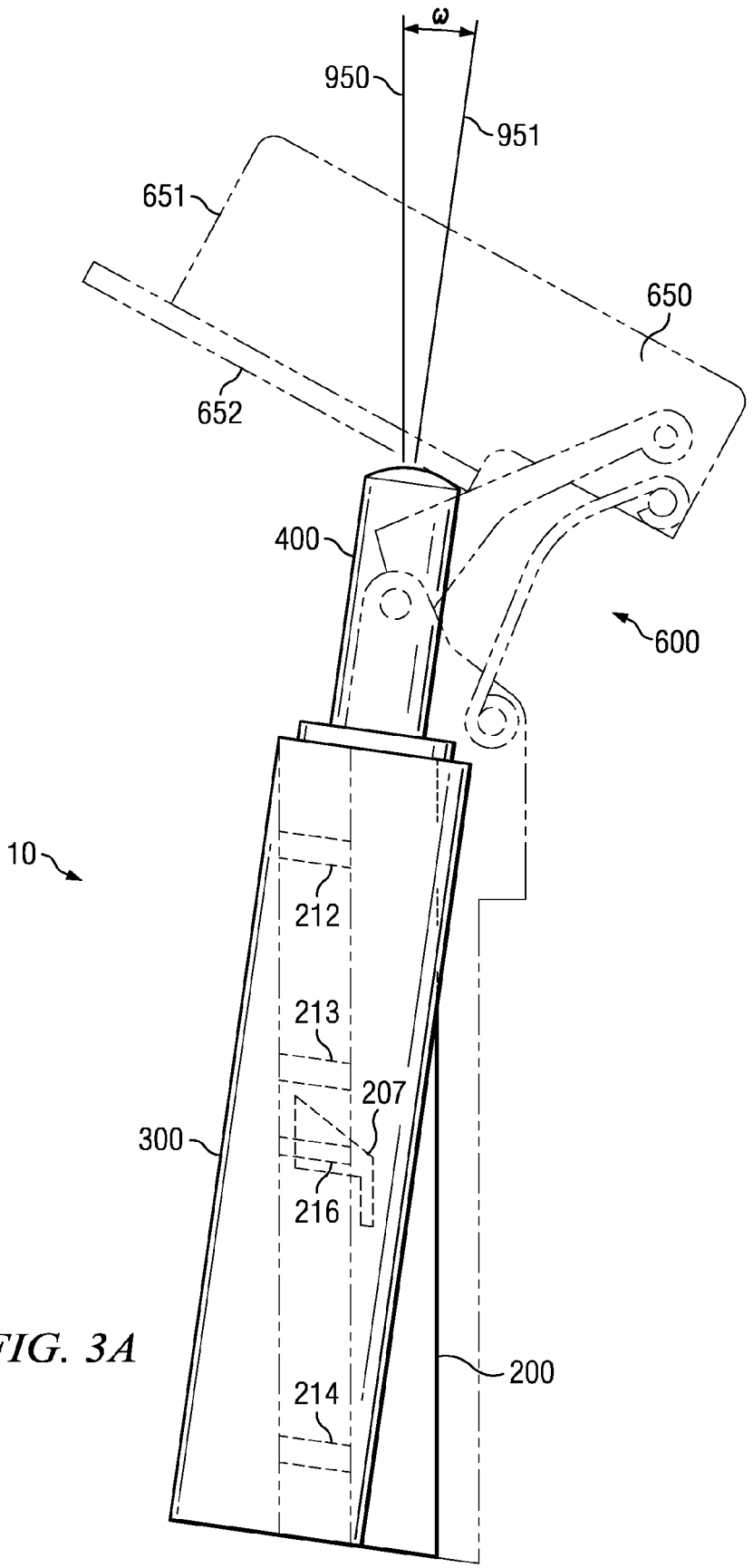
FIG. 3A is a top view of a preferred embodiment attached to a hinge.

Referring to FIG. 3A, attachment 10 is attached to hinge 600 with fastener hook 207 hooked onto the side of a hole in hinge 600. Hinge 600 has door portion 650, hinge cup 651, and hinge plate 652. Housing portion 300 and spring damper assembly 400 are positioned at an off-set angle with respect to connector portion 200. Support abutments 212, 213, 216, and

214 and fastening hook 207 are angled to facilitate the off-set position of housing portion 300 and spring damper assembly 400 by extending generally perpendicularly from the off-set position of housing portion 300 and spring damper assembly 400. Connector portion 200 is positioned along axis 950 and housing portion 300 and spring damper assembly 400 are positioned along axis 951. Axis 950 and axis 951 are separated by off-set angle ω.

In a preferred embodiment, off-set angle ω is in a range of about 1° to about 20°.

EXAMPLE 1

Figure 3C:
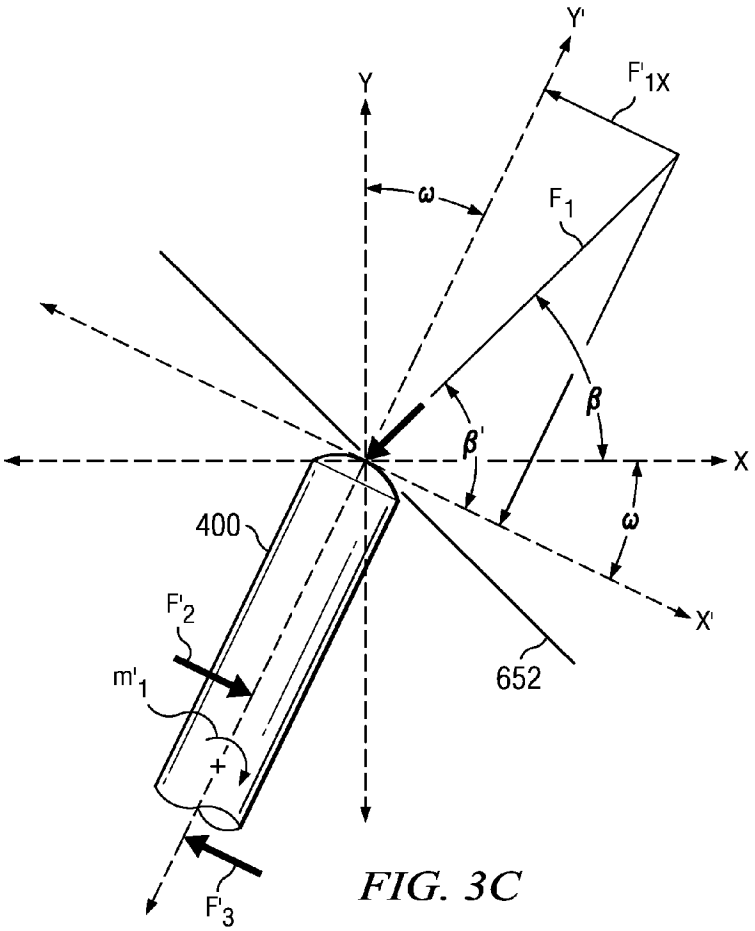
FIG. 3C is a free body diagram of the forces acting on a spring damper assembly of a preferred embodiment.
Figure 3B:
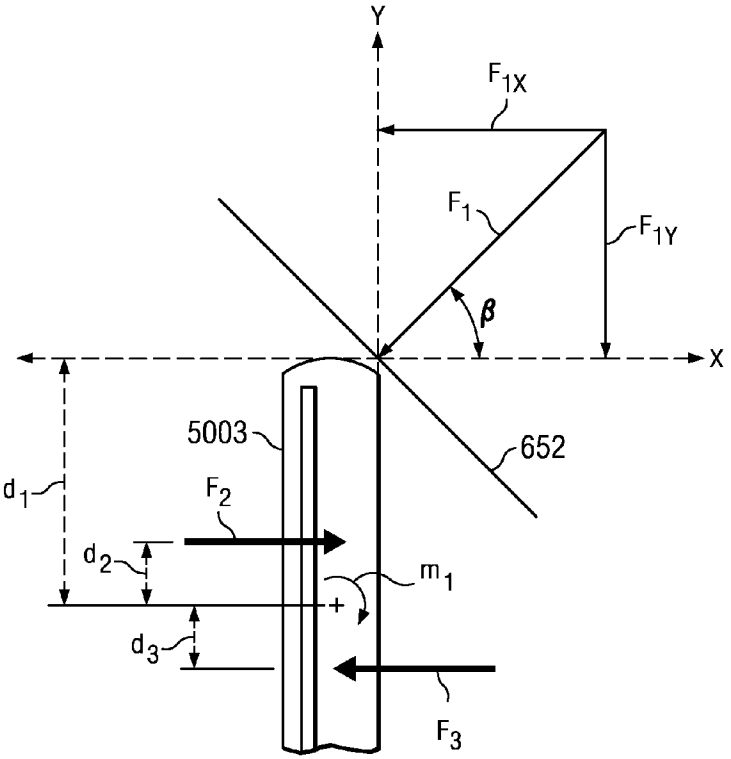
FIG. 3B (PRIOR ART)
FIG. 3B is a free body diagram of the forces acting on a damper of the prior art.

Referring to FIG. 3B, when hinge plate 652 impacts prior art damper 5003, the forces exerted on prior art damper 5003 are defined as follows:

(1) $F_{1x}=F_1 \cos \beta$; where $F_1$ is the force of the door exerted by hinge plate 652 and β is the angle between $F_1$ and the x-axis.

(2) $F_{1x}d_1=m_1$; where $m_1$ is the moment exerted on the piston inside prior art damper 5003 to counteract $F_{1x}$ and $d_1$ is the distance the center of the piston is located from the x-axis at impact, and (3) $F_{1x}d_1=F_2d_2+F_3d_3$; where $d_2$ and $d_3$ are the distances the edges of the piston are from the center of the piston and $F_2$ and $F_3$ are the forces exerted on the piston. $F_{1y}$ is negligible because prior art damper 5003 moves along the y-axis to absorb $F_{1y}$.

Referring to FIG. 3C, when hinge plate 652 impacts spring damper assembly 400 of the preferred embodiment, the forces exerted on spring damper assembly 400 and the results are as follows:

$$F'_{1x}=F_1 \cos \beta';$$

$$F_1 = \frac{F'_{1x}}{\cos\beta'}$$

and from $$F_1 = \frac{F_{1x}}{\cos\beta},$$

then;

$$\frac{F_{1x}}{\cos\beta} = \frac{F'_{1x}}{\cos\beta'};$$

where β'=β+ω, ω is the off-set angle of the preferred embodiment, with β=45°, ω=10°;

$$\frac{\cos(\beta+\omega)}{\cos\beta} = \frac{.573}{.707} \approx 19\%$$

reduction from $F_{1x}$ to $F'_{1x}$; therefore a 9.5% reduction from $F_2$ and $F_3$ to $F'_2$ and $F'_3$, respectively; thereby reducing $m_1$ to $m'_1$.

The example shows that the force resisted by the cylinder $F'_{1x}$ is reduced, thereby reducing wear on the cylinder and increasing the useful life of the damping mechanism.

Figure 4A:
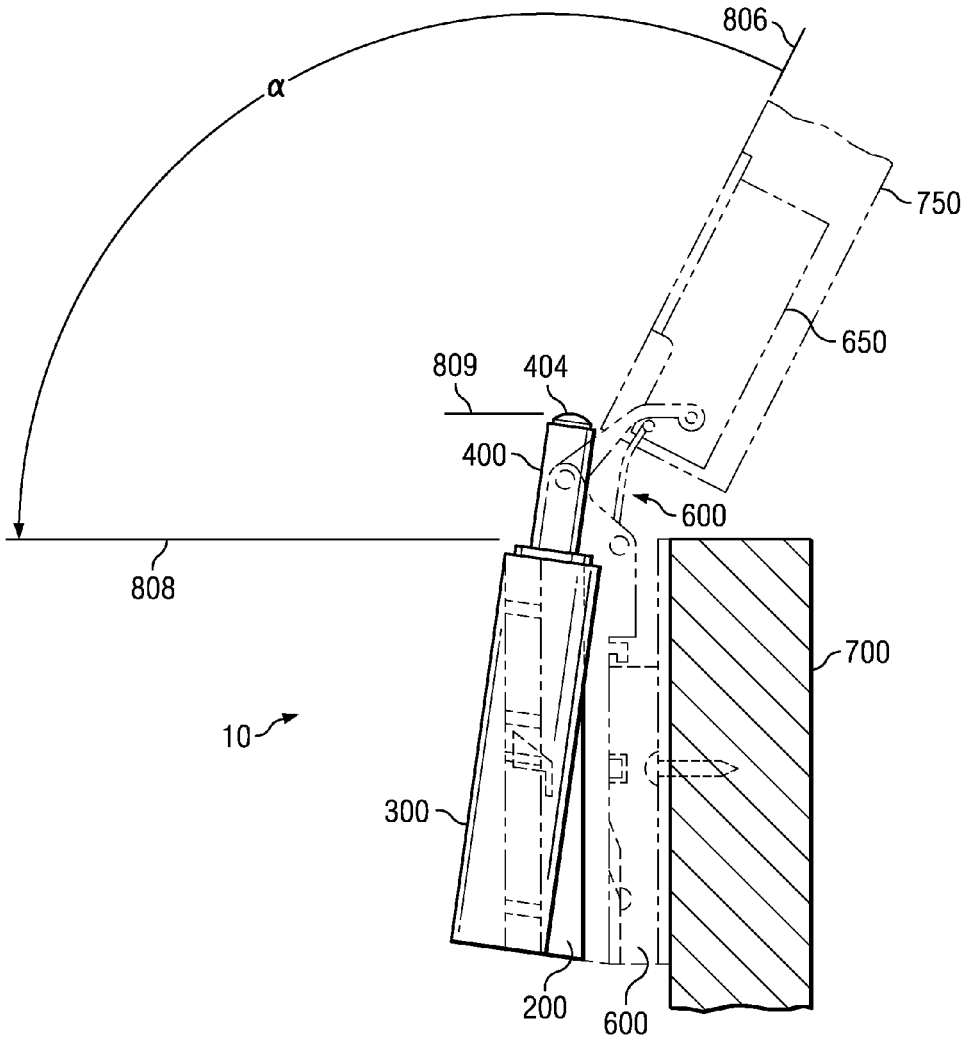
FIG. 4A is a top view of a preferred embodiment attached to a pre-mounted hinge at an open position.
Figure 4B:
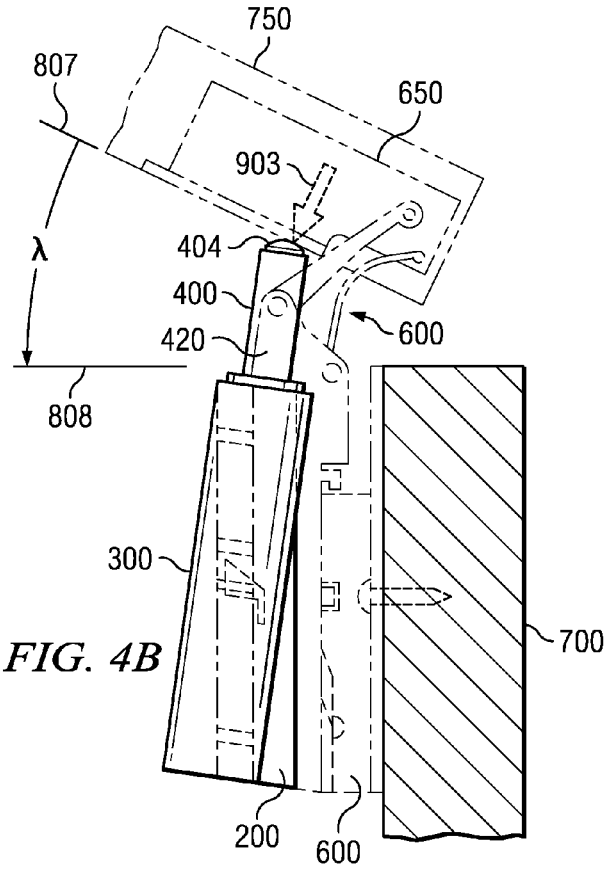
FIG. 4B is a top view of a preferred embodiment attached to a pre-mounted hinge at an impact position.
Figure 4C:
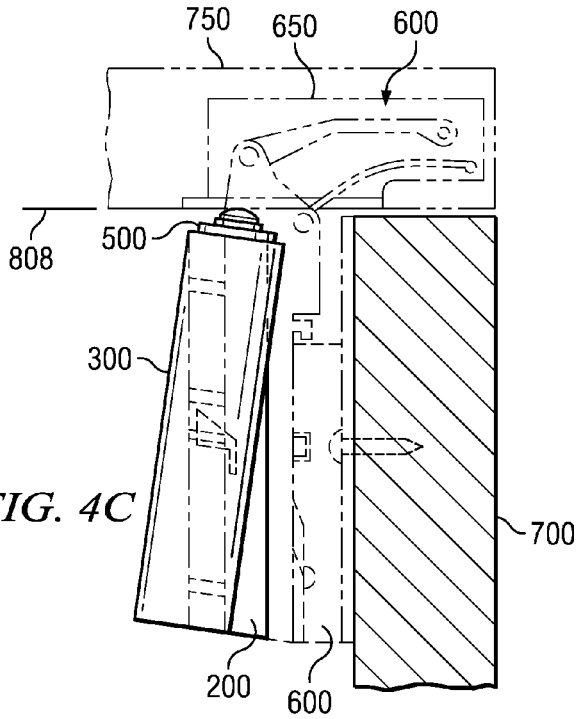
FIG. 4C is a top view of a preferred embodiment attached to a pre-mounted hinge at a closed position.

Referring to FIGS. 4A, 4B, and 4C in use, attachment 10 is attached to hinge 600, which is fastened to cabinet 700. Attachment 10 is clipped onto hinge 600 with fastener hook 207. To detach attachment 10, attachment 10 is pulled from hinge 600. Hinge 600 has door portion 650, which is attached to door 750. Door portion 650 and door 750 begin at open position 806 and travel through angle α with a closing speed sufficient to propel door portion 650 and door 750 to closed position 808 to ensure door 750 will close and not remain open after contact with spring damper assembly 400. Angle α is approximately 120°. Spring damper assembly 400 is in ready position 809.

At impact position 807, door portion 650 applies force 903 on spring damper assembly 400. The flexibility of flexible tip 404 and the contents of cylinder 420 of spring damper assembly 400 urge to absorb force 903. As door 750 and door portion 650 continue to swing closed through angle λ, piston rod 408 remains stationary relative to housing portion 300 and receiver 500. Angle λ is approximately 30°. Spring damper assembly 400 slides through housing portion 300 against the bias of the spring and the piston attached to piston rod 408, moving through the inside of cylinder 420 to closed position 808. The damper fluid moves through the fluid channels in the piston to dampen force 903.

Figure 5:
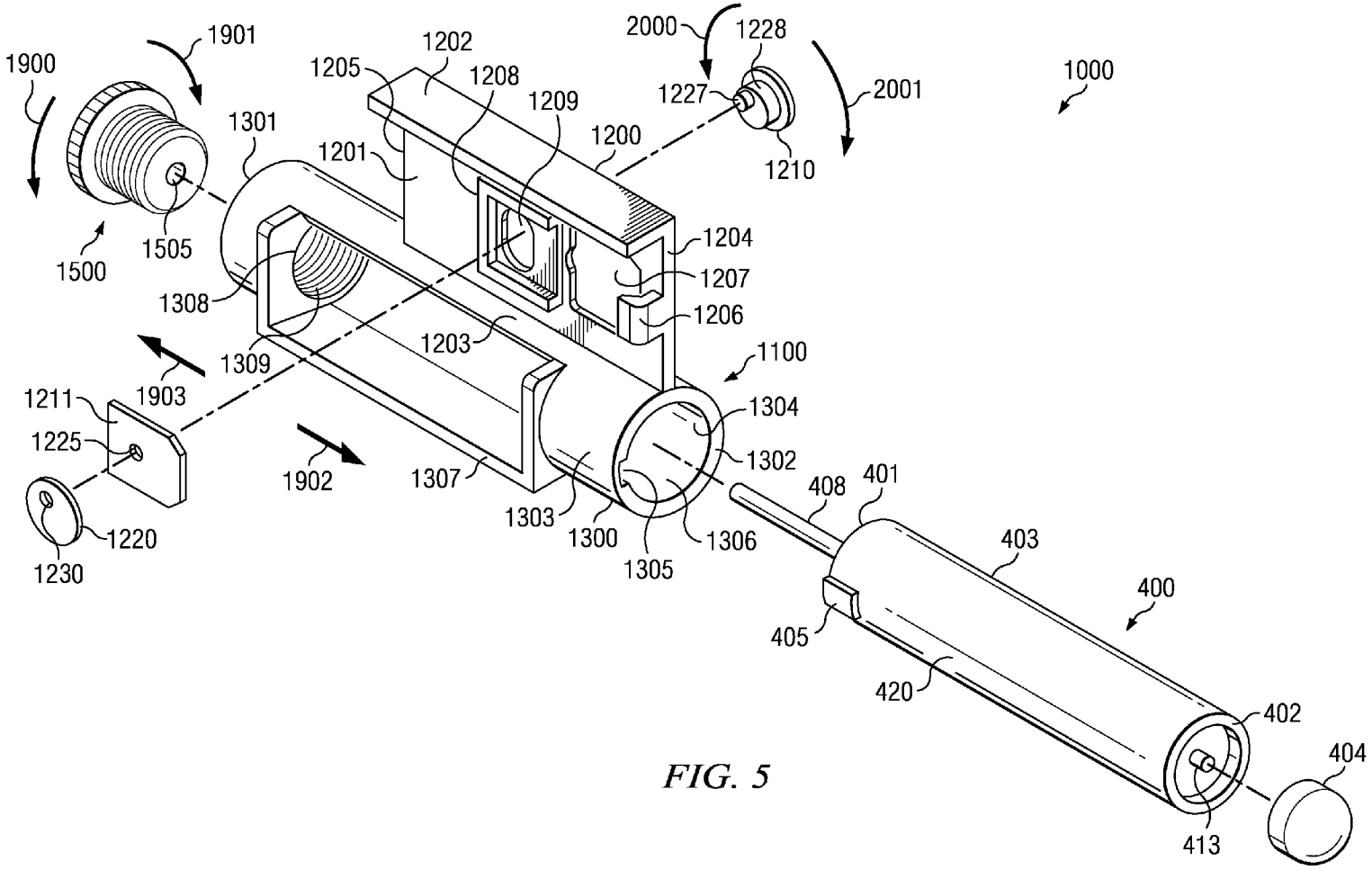
FIG. 5 is an exploded isometric view of a preferred embodiment.

Referring to FIG. 5 in another embodiment, attachment 1000 comprises body 1100, spring damper assembly 400, and adjustment knob 1500. Body 1100 has connector portion 1200 and housing portion 1300. Connector portion 1200 has base 1201, attached to housing portion 1300. Connector portion 1200 extends generally radially from housing portion 1300. Base 1201 is attached to sides 1202 and 1203. Base 1201 has ends 1204 and 1205. Side 1202, base 1201, and side 1203 form a generally rectangular channel. End 1204 includes securing hook 1206. Base 1201 has adjustment hole 1207 and cam locking mechanism 1208. Cam locking mechanism 1208 further includes hole 1209 to receive fastener 1210. Fastener 1210 has cam pin 1227. Fastener 1210 is situated through hole 1209. Cam pin 1227 is inserted through hole 1225 of cam lock 1211 and hole 1230 of cam cap 1220 and secured to cam cap 1220, as will be further described below. Adjustment hole 1207 has sufficient dimensions to allow a user to adjust a pre-mounted hinge to which attachment 1000 is attached.

Housing portion 1300 has receiver end 1301, spring damper end 1302, outside surface 1303, and inside surface 1304. Receiver end 1301 has hole 1308. Hole 1308 has internal threads 1309, which are adapted to receive adjustment knob 1500. Spring damper end 1302 has hole 1306. Hole 1306 has slot 1305 to slidingly receive guide flange 405 on spring damper assembly 400. Gap 1307 is positioned axially along housing portion 1300 to conserve weight and material costs.

In a preferred embodiment, body 1100 is made of a zinc die cast, but can be made of a suitable plastic, a suitable metal, or a suitable metal alloy. Fastener 1210 can be a multitude of fasteners known in the art. Cam lock 1211 and cam cap 1220 are made of a durable metal, but can be made of a durable plastic or metal alloy.

Adjustment knob 1500 has receiving hole 1505 to removably support piston rod 408 of spring damper assembly 400. Adjustment knob 1500 further has a set of external threads that match internal threads 1309 in hole 1308 of housing portion 1300.

In a preferred embodiment, adjustment knob 1500 is made of a durable plastic, but can be made of a durable metal or metal alloy.

Spring damper assembly 400 is slidingly engaged with inside surface 1304 of housing portion 1300 and removably supported by receiving hole 1505 of adjustment knob 1500. Spring damper assembly 400 comprises cylinder 420 having proximal end 401, distal end 402, and outside surface 403. Flexible tip 404 has a generally convex shape and is removably attached to distal end 402 by frictional engagement with mounting post 413 and distal end 402. Guide flange 405 is attached to outside surface 403 at proximal end 401 and is slidingly engaged with slot 1305 of housing portion 1300. Piston rod 408 is slidingly engaged with proximal end 401 and is connected to a piston. The piston is slidingly engaged with the inside surface of cylinder 420. The inside surface of cylinder 420 forms a fluid chamber, which contains a damper fluid. Piston rod 408 is concentrically aligned with a piston guide in proximal end 401. The piston guide forms a seal with piston rod 408 to prevent the damper fluid from escaping cylinder 420. The piston has at least one fluid channel through which the damper fluid can pass. A spring is positioned between the piston and distal end 402 and urges against the piston and distal end 402.

In a preferred embodiment, cylinder 420 is formed of extruded plastic or other suitable materials for lightweight durability and affordability. Piston rod 408 is made of aluminum, but can be made of other metals or metal alloys with similar lightweight and strength properties. The piston is made of aluminum or can be made of other durable, lightweight materials known in the art. Flexible tip 404 may be made of plastic, rubber, or a dense energy absorbing foam rubber. The damper fluid is a mineral oil, but other fluids known in the art may be suitably employed. The damper fluid fills approximately 80% of the volume of the inside of cylinder 420 less the volumes of piston rod 408, the piston, and the spring. Other suitable fluid capacities known in the art may be employed as well. The spring is made of a durable metal with a spring constant in a range of approximately 10 lbs./inch to 20 lbs./inch.

Adjustment knob 1500 is threadingly engaged with receiver end 1301. Spring damper assembly 400 slides into hole 1306 at spring damper end 1302. Guide flange 405 slides into slot 1305 to allow piston rod 408 to be removably supported in receiving hole 1505.

The damping functionality is adjusted by turning adjustment knob 1500 in direction 1900 or in direction 1901. Advancing adjustment knob 1500 further axially into housing portion 1300 in direction 1902 at receiver end 1301 results in increasing the compressive strength of spring damper assembly 400 because spring damper assembly 400 extends further axially away from housing portion 1300 at spring damper end 1302 and catches the swinging door earlier in its swing path.

Retreating adjustment knob 1500 out of housing portion 1300 in direction 1903 at receiver end 1301 results in decreasing the compressive strength of spring damper assembly 400 because the swinging door will meet spring damper assembly 400 further along in its swing path.

Figure 6A:
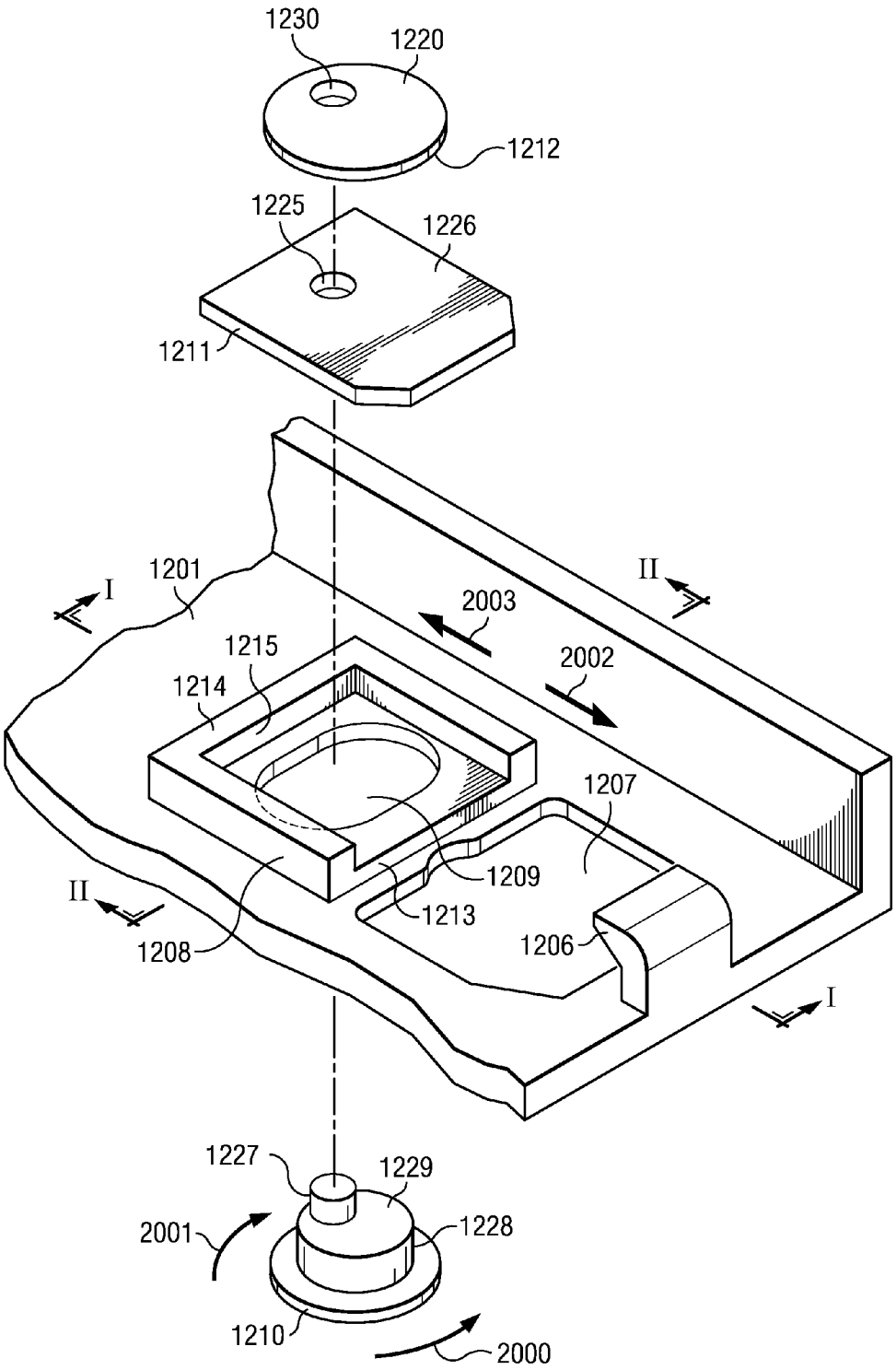
FIG. 6A is a detail elevation view of a connector portion of a preferred embodiment.

Referring to FIG. 6A, cam locking mechanism 1208 includes riser 1213, which is attached to base 1201. Channel 1214 is connected onto riser 1213 and is generally "TU"-shaped to slidingly receive cam lock 1211. Cam lock 1211 is seated into inside surface 1215 of channel 1214. In a preferred embodiment, cam lock 1211 has a 5% to 10% tolerance of dimensions to enable cam lock 1211 to slidingly engage with channel 1214.

Fastener 1210 has shaft 1228 and cam pin 1227. Cam pin 1227 is attached to the end of shaft 1228 in an off-center position on flat surface 1229. Shaft 1228 is situated through hole 1209 and adjacent to cam lock 1211. Cam pin 1227 is situated through hole 1225 of cam lock 1211 to attach to cam cap 1220 by insertion into hole 1230 and welded into place by a welding means known in the art. Bottom surface 1212 of cam cap 1220 is then slidingly secured onto surface 1226 of cam lock 1211. Cam pin 1227 freely rotates within hole 1225.

In another embodiment, cam cap 1220 is eliminated and the end of cam pin 1227 is stamped to deform the end of cam pin 1227 to a diameter larger than the diameter of hole 1225 to secure cam pin 1227 to cam lock 1211. Cam pin 1227 freely rotates within hole 1225.

Referring to FIGS. 5 and 6A, soft close hinge attachment 1000 is mounted onto a pre-mounted hinge by securing hook 1206 and cam locking mechanism 1208. Cam locking mechanism 1208 secures soft close hinge attachment 1000 to a pre-mounted hinge by turning fastener 1210 in direction 2000 or 2001. The rotation of fastener 1210 and the off-center position of cam pin 1227 advances cam lock 1211 in direction 2002 extending partially over adjustment hole 1207; thereby coupling soft close hinge attachment 1000 to a pre-mounted hinge, as will be further described below.

To detach attachment 1000 from a pre-mounted hinge, fastener 1210 is rotated in direction 2000 or 2001, thereby retreating cam lock 1211 in direction 2003 to re-seat cam lock 1211 on riser 1213, as will be further described below. Attachment 1000 is then pulled from the pre-mounted hinge.

Figure 6B:
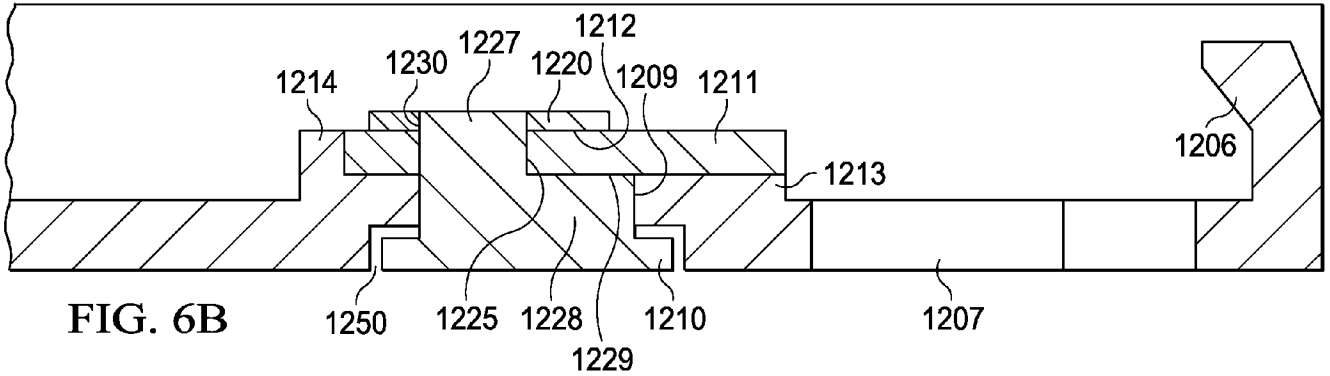
FIG. 6B is an assembled partial section view a connector portion of a preferred embodiment, taken along line I-I of FIG. 6A.
Figure 6C:
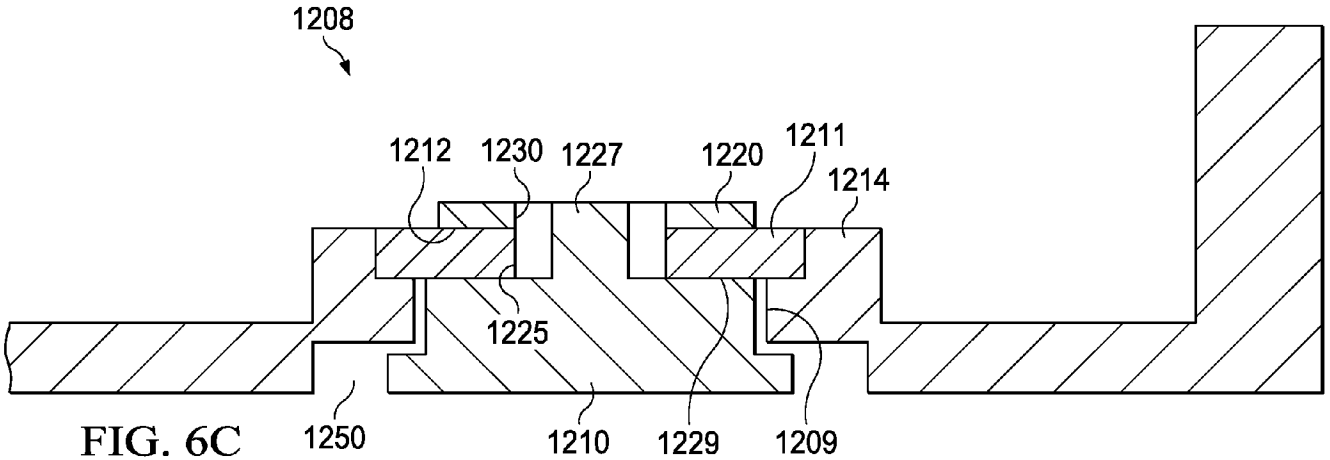
FIG. 6C is a partial section view a connector portion of a preferred embodiment, taken along line II-II of FIG. 6A.

Referring to FIGS. 6B and 6C, shaft 1228 of fastener 1210 resides in recess 1250 and hole 1209. Cam pin 1227 is loosely positioned in hole 1225 of cam lock 1211. Cam pin 1227 is fixed in hole 1230 of cam cap 1220 by welding, press fit or a suitable epoxy adhesive. Cam lock 1211 is slidingly positioned between flat surface 1229 of shaft 1228 and bottom surface 1212 of cam cap 1220. Cam pin 1227 is free to rotate within hole 1225. Cam lock 1211 is constrained to slide in channel 1214 by riser 1213. In an alternate embodiment, cam cap 1220 is formed by physically deforming cam pin 1227 during assembly.

Recess 1250 and hole 1209 have an oblong shape to enable fastener 1210 to move laterally within hole 1209 and recess 1250 to compensate for the offset position of cam pin 1227, as will be described below.

The movement of cam lock 1211 and fastener 1210 will be described with reference to FIGS. 6D-6G. For clarity, cam cap 1220 is not shown.

Figure 6E:
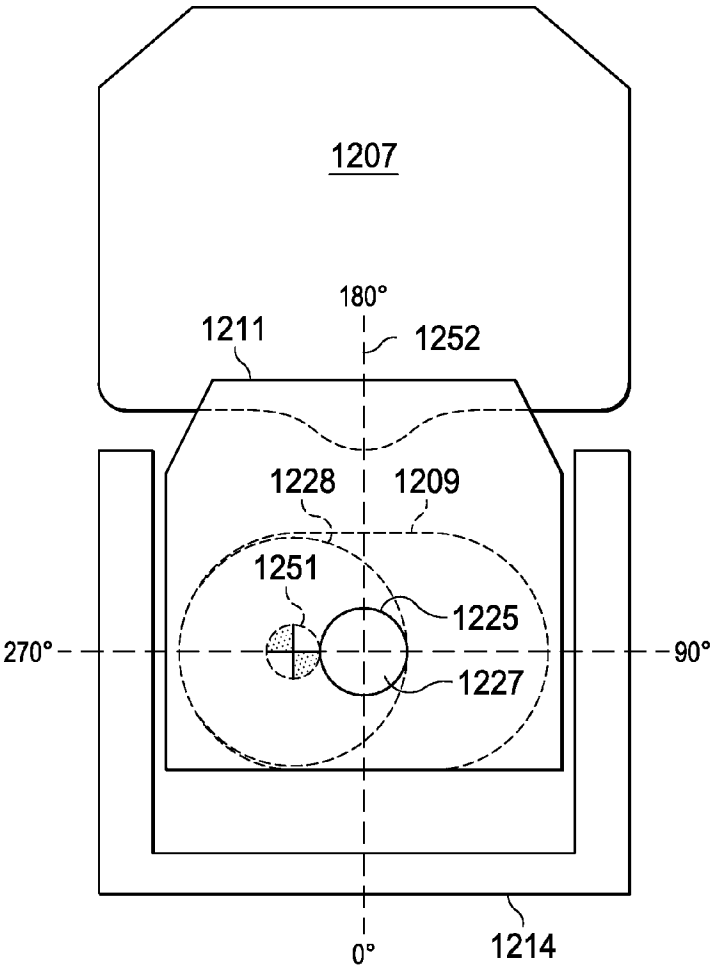
FIG. 6E is detail view of a connector portion in a partial extended position of a preferred embodiment.
Figure 6D:
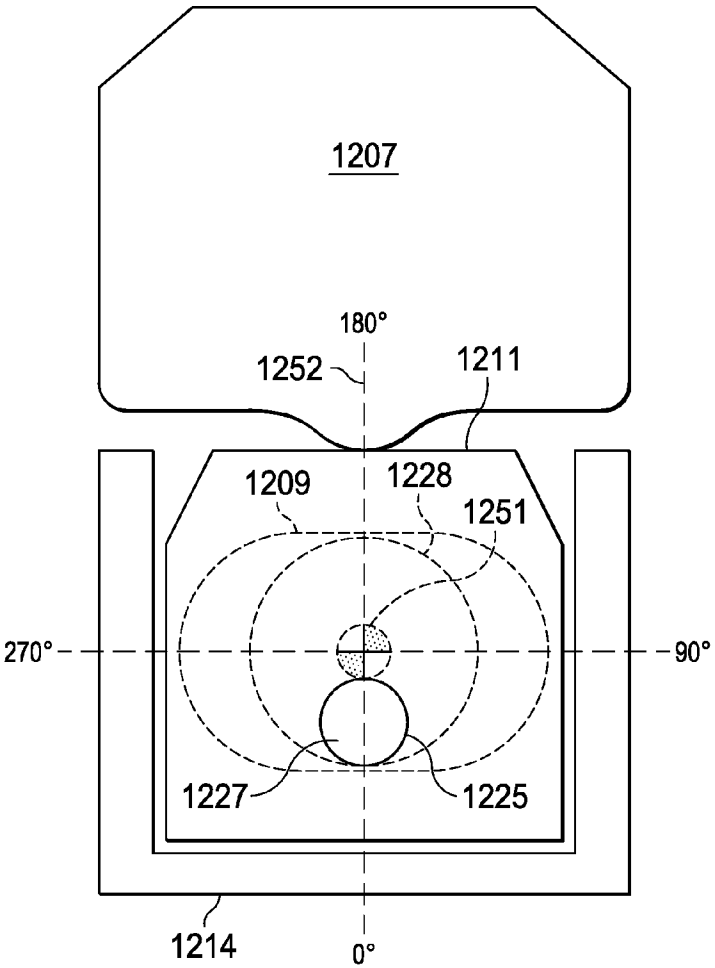
FIG. 6D is detail view of a connector portion in a retracted position of a preferred embodiment.

Referring to FIG. 6D, cam lock 1211 is in a retracted position and seated in channel 1214. Shaft 1228 of fastener 1210 has central axis 1251. To advance cam lock 1211 from the retracted position towards adjustment hole 1207, shaft 1228 may be rotated in a clockwise direction or a counterclockwise direction about central axis 1251.

Referring to FIG. 6E, by way of example, cam lock 1211 is in a partially extended position. Shaft 1228 is rotated in hole 1209 about central axis 1251 in a counterclockwise direction approximately 90° from the retracted position in FIG. 6D to the partially extended position as shown. The rotation of shaft 1228 causes cam pin 1227 to rotate in hole 1225 of cam lock 1211 and shaft 1228 to translate in hole 1209 to urge cam lock 1211 towards adjustment hole 1207 along axis 1252.

Figure 6G:
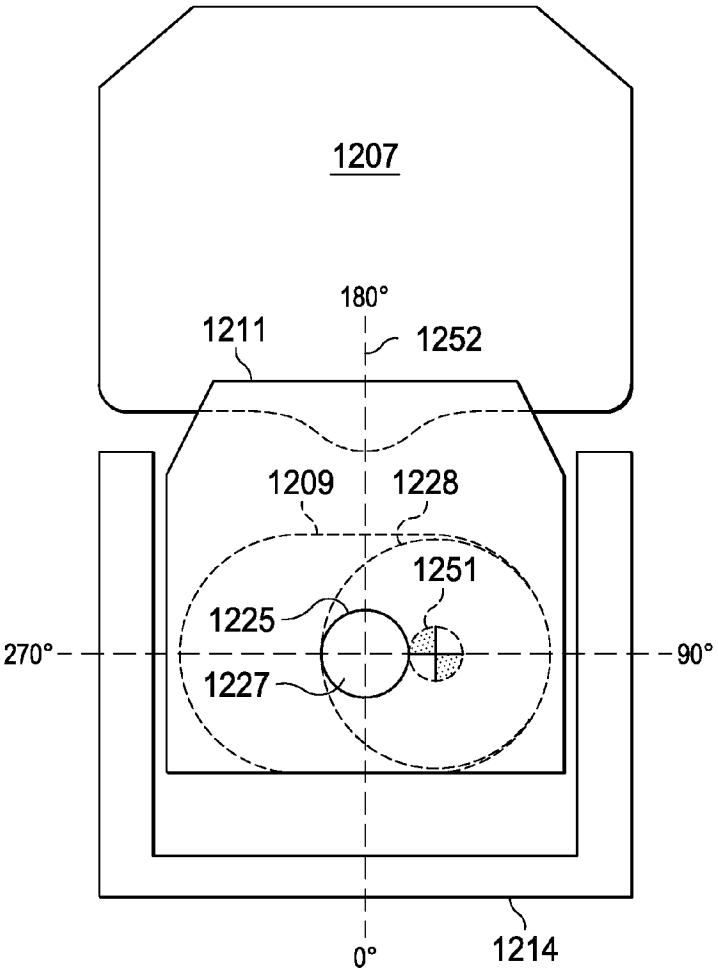
FIG. 6G is a detail view of a connector portion in a partial retracted position of a preferred embodiment.
Figure 6F:
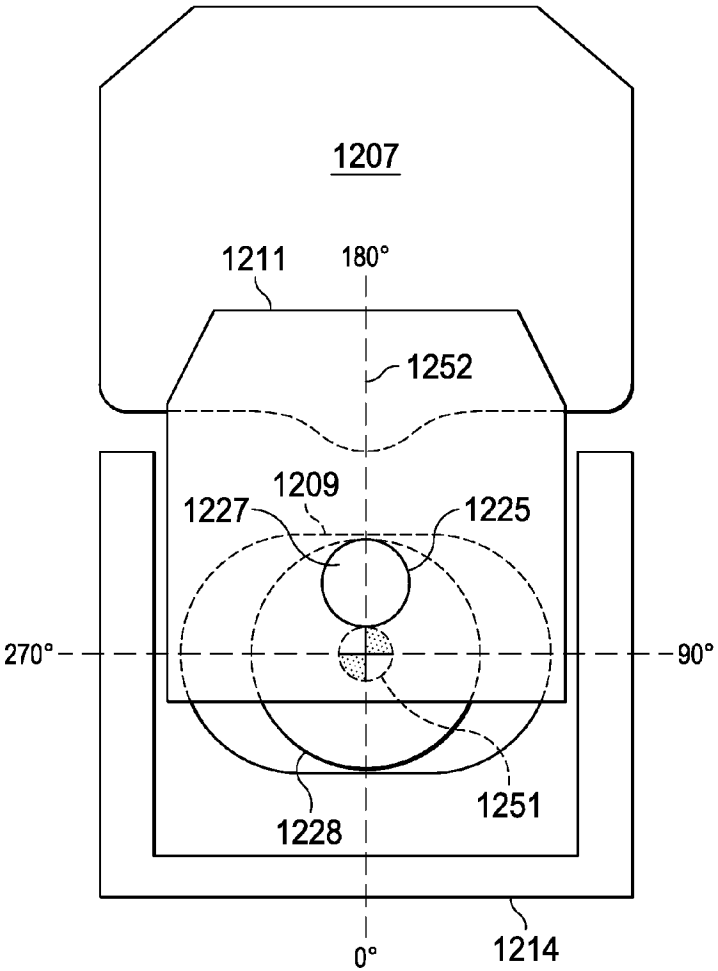
FIG. 6F is detail view of a connector portion in an extended position of a preferred embodiment.

Referring to FIG. 6F, cam lock 1211 is in an extended position, partially covering adjustment hole 1207. Shaft 1228 is rotated in hole 1209 about central axis 1251 approximately 90° in a counterclockwise direction from the partially extended position in FIG. 6E to the extended position as shown. The rotation of shaft 1228 causes cam pin 1227 to rotate in hole 1225 of cam lock 1211 and shaft 1228 to translate in hole 1209 to urge cam lock 1211 towards adjustment hole 1207.

In the extended position, cam lock 1211 engages a pre-mounted hinge to secure attachment 1000 to the hinge.

To retreat cam lock 1211 from the extended position away from adjustment hole 1207, shaft 1228 may be rotated in a clockwise direction or a counterclockwise direction about central axis 1251.

Referring to FIG. 6G by way of example, cam lock 1211 is in a partially retracted position. Shaft 1228 is rotated in hole 1209 about central axis 1251 from the extended position in FIG. 6F in a counterclockwise direction approximately 90° to the partially retracted position as shown. The rotation of shaft 1228 causes cam pin 1227 to rotate in hole 1225 of cam lock 1211 and shaft 1228 to translate in hole 1209 to retreat cam lock 1211 away from adjustment hole 1207 along axis 1252.

To complete the retraction of cam lock 1211, shaft 1228 is rotated in hole 1209 about central axis 1251 in a counterclockwise direction approximately 90° from the partially retracted position in FIG. 6G to the retracted position in FIG. 6D. The rotation of shaft 1228 causes cam pin 1227 to rotate in hole 1225 of cam lock 1211 and shaft 1228 to translate in hole 1209 to retreat cam lock 1211 away from adjustment hole 1207 along axis 1252 and reseat cam lock 1211 in channel 1214. In the retracted position, attachment 1000 may be detached from the pre-mounted hinge.

It will be appreciated by those skilled in the art that shaft 1228 may be rotated in a clockwise direction to extend and retract cam lock 1211, thereby reversing the order of positions described in FIGS. 6D, 6E, 6F, and 6G.

Figure 7A:
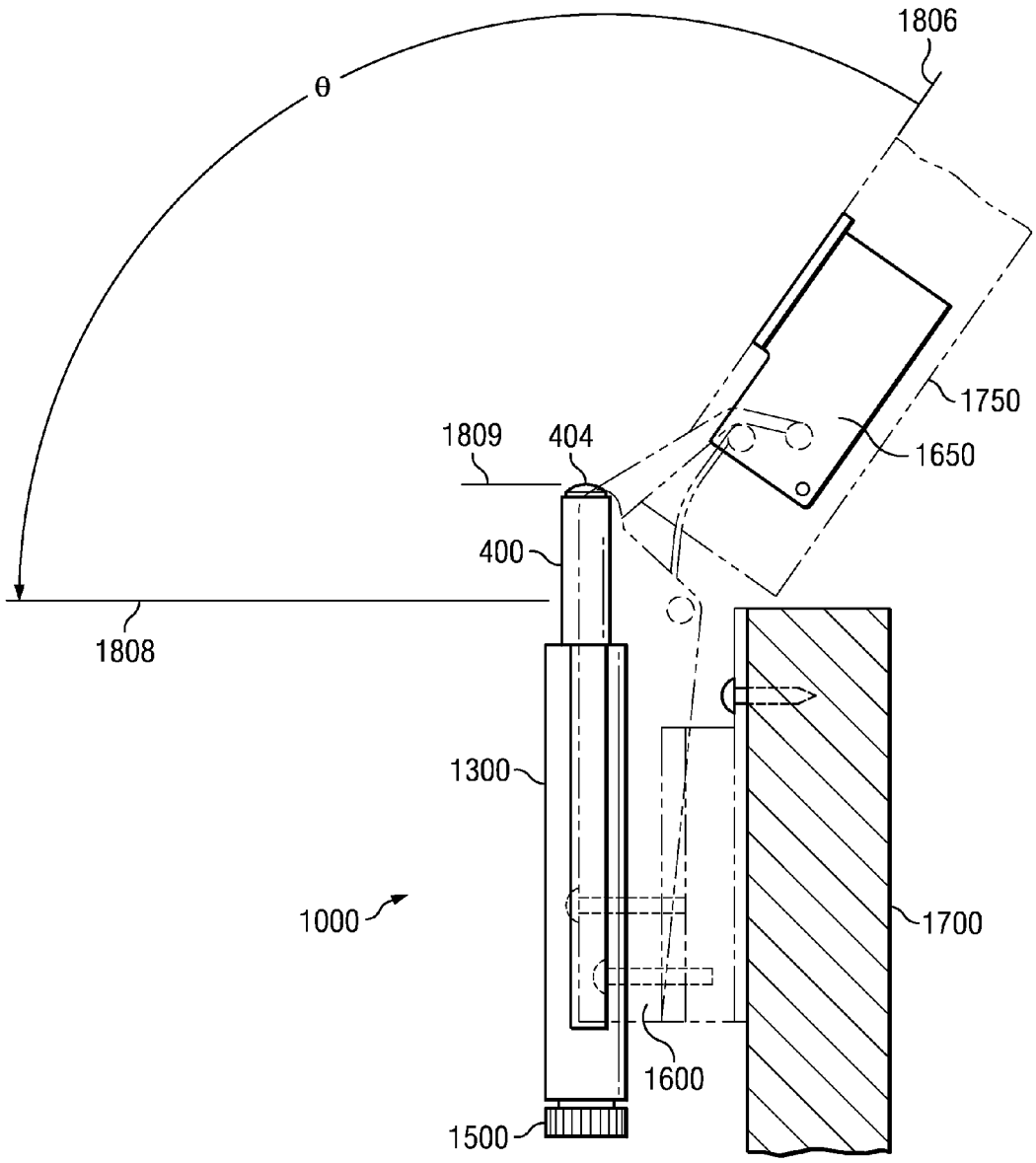
FIG. 7A is a top view of a preferred embodiment attached to a pre-mounted hinge at an open position.
Figure 7C:
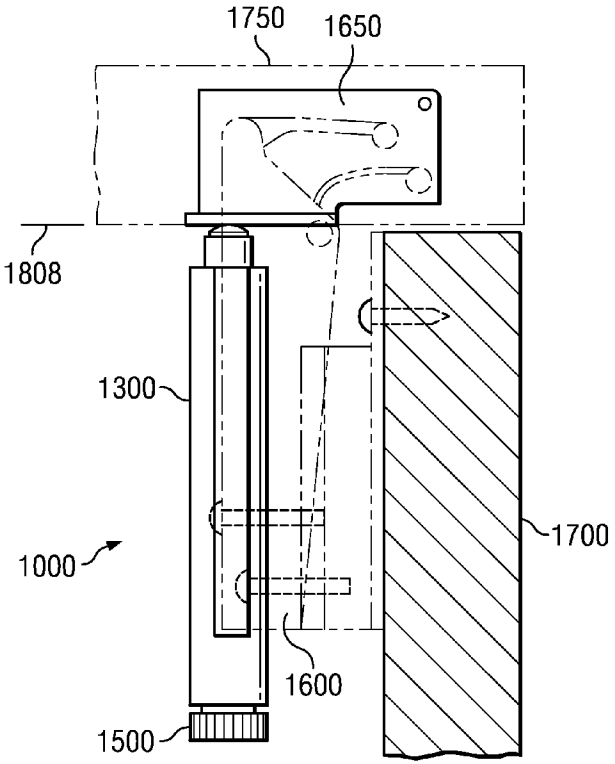
FIG. 7C is a top view of a preferred embodiment attached to a pre-mounted hinge at a closed position.
Figure 7B:
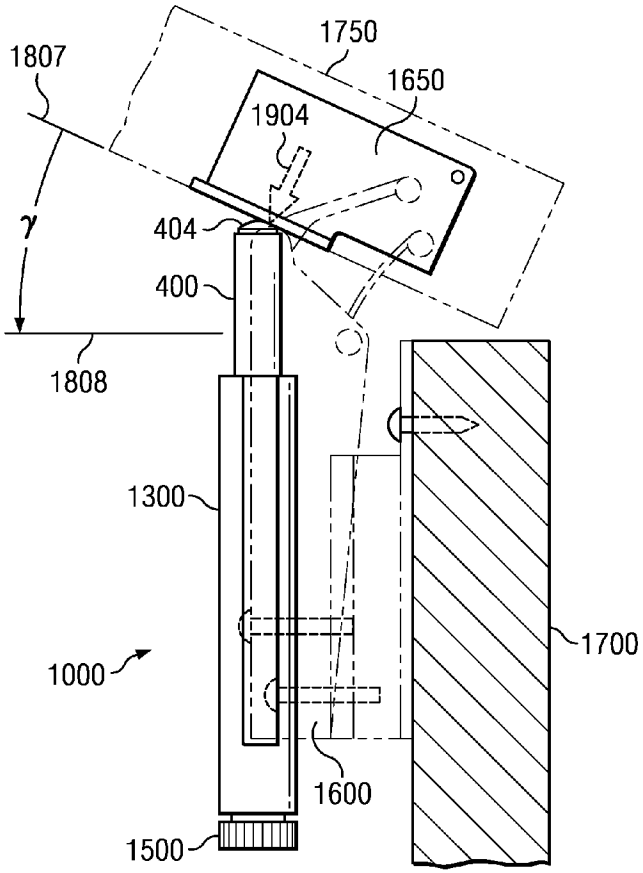
FIG. 7B is a top view of a preferred embodiment attached to a pre-mounted hinge at an impact position.

Referring to FIGS. 7A, 7B, and 7C, in use, attachment 1000 is attached to hinge 1600 with securing hook 1206 and cam locking mechanism 1208, which is fastened to cabinet 1700. Hinge 1600 has door portion 1650, which is attached to door 1750. Door portion 1650 and door 1750 begin at open position 1806 and travel through angle θ with a closing speed sufficient to propel door portion 1650 and door 1750 to closed position 1808 to ensure door 1750 will close and not remain open after contact with spring damper assembly 400. Angle θ is approximately 120°. Spring damper assembly 400 is in ready position 1809.

At impact position 1807, door portion 1650 applies force 1903 on spring damper assembly 400. The flexibility of flexible tip 404 and the contents of cylinder 420 of spring damper assembly 400 urge to absorb force 1904. As door 1750 and door portion 1650 continue to swing closed through angle γ, piston rod 408 remains stationary relative to housing portion 1300 and adjustment knob 1500. Angle γ is approximately 30°. Spring damper assembly 400 slides through housing portion 1300 against the bias of the spring and the piston attached to piston rod 408, moving through the fluid chamber to closed position 1808. The damper fluid moves through the at least one fluid channel to dampen force 1904.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

The invention claimed is:

1. An attachment for detachable coupling to a pre-mounted hinge comprising:
- a housing portion;
- an adjustment knob threadingly engaged with the housing portion;
- a spring damper assembly supported by the housing portion and removably supported by the adjustment knob;
- a connector portion attached to the housing portion;
- the connector portion further comprising a base;
- a channel attached to the base;
- a cam lock slidingly engaged with the channel;
- a support hole integrally formed in the channel;
- a fastener hole integrally formed in the cam lock;
- a shaft rotatively positioned in the support hole;
- a cam pin attached to the shaft and rotatively positioned in the fastener hole;
- whereby a rotation of the shaft rotates the cam pin in the fastener hole, translates the shaft within the support hole, and translates the cam lock within the channel such that the attachment is detachably coupled to the pre-mounted hinge.

2. The attachment of claim 1, further comprising a cam cap attached to the cam pin and slidingly secured adjacent to the cam lock.

3. The attachment of claim 1, wherein the cam pin is positioned off-center with respect to the shaft.

4. The attachment of claim 1, wherein the connector portion further comprises a hook attached to the base and wherein the connector portion is releasably connectable to the pre-mounted hinge.

5. The attachment of claim 1, wherein the housing and the spring damper assembly are positioned at an off-set angle with respect to the attachment channel.

6. The attachment of claim 5, wherein the off-set angle is a range from about 1° to about 20°.

* * * * *